United States Patent [19]

Slagle

[11] Patent Number: 4,535,992

[45] Date of Patent: Aug. 20, 1985

[54] TRAINING DEVICE FOR PUTTING GOLF BALLS

[76] Inventor: Frederick A. Slagle, 7050 Griswold Rd., Madison, Ohio 44057

[21] Appl. No.: 527,951

[22] Filed: Sep. 1, 1983

[51] Int. Cl.[3] ..... A63B 69/36; A63B 53/04

[52] U.S. Cl. ..... 273/194 A; 273/174

[58] Field of Search ..... 273/174, 194 A, 32 B, 273/162 E, 167 A, 173, 172, 167 E, 129 M, 129 L

[56] References Cited

U.S. PATENT DOCUMENTS 2,426,274 8/1947 Kramer ..... 273/174

3,727,920 4/1973 Scott ..... 273/194 A X 3,992,013 11/1976 Golden ..... 273/194 A X 4,102,405 7/1978 Carman ..... 273/32 B X

*Primary Examiner*—George J. Marlo

*Attorney, Agent, or Firm*—Watts, Hoffmann, Fisher & Heinke Co.

[57] ABSTRACT

A golf training device and more particularly to a training device for improving ones skills in putting a golf ball including a reel assembly having one or more reel members each having a plurality of axially spaced, annular disc-like elements which provide a line-contact for maximizing the tracking action of the putter head during the putting stroke.

6 Claims, 16 Drawing Figures

TRAINING DEVICE FOR PUTTING GOLF BALLS

DESCRIPTION

1. Technical Field

The present invention relates to a golf training device and more particularly relates to a training device for use in improving ones skills in respect to putting a golf ball on a putting surface such as a golf green. Specifically, the invention relates to the construction and the function of a new novel training device for use as a teaching aid for improving ones putting skills that incorporates a reel assembly having one or more reel members each having a plurality of axially spaced, annular disc-like elements which provide a substantially line-contact for maximizing the tracking action of the putter head during the putting stroke.

2. Related Applications

This application is related to applicants co-pending United States application for patent entitled "Training a Method and System for Golf Putting".

BACKGROUND ART

It has long been recognized by most any golfer—beginner or professional—that one of the most important, if not the most important, aspects relating to the game of golf deals with that to be accomplished on the putting surface, namely, putting the golf ball into the hole. Indeed, this is the single aspect of the game which is generally most difficult and frustrating to master and hence, requires the most training and practice. Most all would agree with the truism that "one drives for show but putts for dough".

In the present invention, it has been found that the primary cause for inaccurate or erratic putting stems simply from an improper putting stroke. This has to do with the golfer's normal tendency to "pick up" the club head during the take away and during the hitting or return stroke so as not to strike the ball square or in the "sweet-spot", as they would say. This is an especially acute problem with the putting stroke wherein it is highly important that the putting stroke be in the form of a short, straight take-away and with a return of the putter head in this same track and through the "ball" contact zone to perfect the putting stroke. In applicant's co-pending application, relating to the training method and system for accomplishing this perfect putting stroke, it is noted to be essential that the putting stroke result in providing over-spin on the ball so that the ball, in turn, creates its own path to the hole.

For reference to prior putting devices and/or methods utilizing various type ball bearing or roller arrangements, reference may be had to U.S. Pat. Nos. 2,255,332; 2,300,043; 2,426,274; and 3,680,868.

DISCLOSURE OF THE INVENTION

In accordance with the invention, there is provided a training device for use in improving ones skills in putting a golf ball which incorporates a construction which enables the golfer to consistently utilize that which is deemed to be a perfect putting stroke. This stroke incorporates a relatively short take-away which parallels the putting surface and which enables the golfer to then strike through the "ball" in the same stroke path so as to move the ball with an upward stroke of the putter face as it approaches and reaches the "ball" contact zone. The object of this upward stroke being to impart a top-spin or over-spin to the ball. The result of this top spin on the ball is to provide a more constantly true line of direction, speed, and control. More specifically, the training device of the present invention incorporates a novel grooved reel assembly which imparts a tracking effect to the putter head as it is moves backwardly and forwardly across the putting surface. This tracking effect is accomplished by optimum friction characteristics developed from the reel assembly. Accordingly, a primary object of the present invention is to systematically, via practice, and mechanically program the golfer's putting stroke to the form of a short, straight take-away and with a return of the putter head in this same pathway. This training putter constitutes a part of the system utilized in applicants aforementioned method which may be commercially identified as the "PROGRESSIVE PUTTING TECHNIQUE".

As an example in practicing this method, the training putter device is placed on the putting surface and, applying a slight downward pressure, it is then moved back and forth until the golfer acquires a "feel" for the stroke pattern. During this time, it is emphasized not to lift the putter head from the putting surface. Maintaining the putter head on the putting surface throughout the stroke ensures that the golfer will program a short take-away with accelleration through the contact zone. This exercise is repeated until the golfer becomes comfortable with the new feeling of keeping the putter head down. Then the ball may be placed down and the exercise is repeated while rolling the training device through the contact zone. Again, the golfer is reminded not to lift the putter head. By applying downward pressure, the training device automatically does this job. This exercise is now repeated with the ball until the golfer develops a programed short, low, straight takeaway and with accelleration through the ball. Further description and details of the PRO-GRESSIVE PUTTING TECHNIQUE is described in applicants aformentioned co-pending application.

Other advantages and objects of the present invention will be appartent as the following description proceeds when taken in conjunction with the accompanying drawings.

BEST MODE FOR CARRYING OUT THE INVENTION

Figure 1:
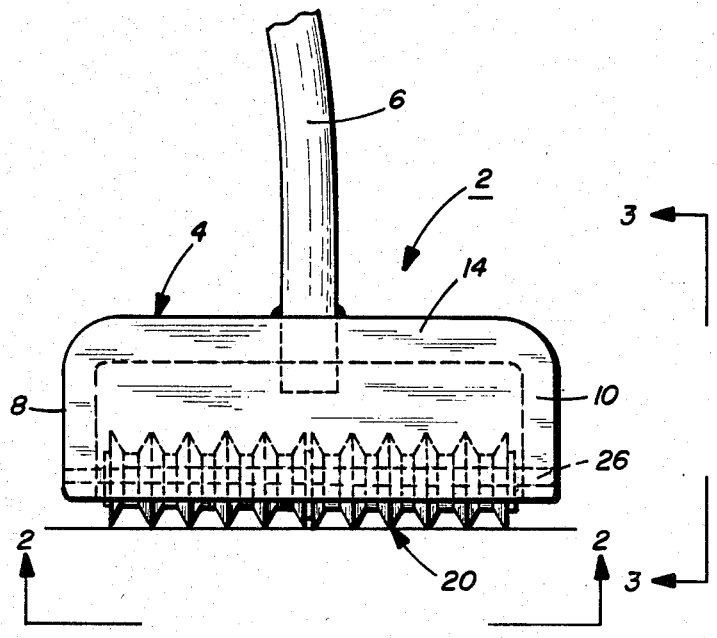
FIG. 1 is a fragmentary rear elevation view of the golf training device of the present invention.
Figure 3:
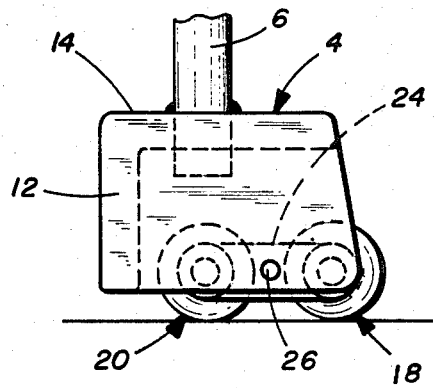
FIG. 3 is a fragmentary side elevation view looking in the direction of the line 3—3 of FIG. 1.

Turning again to the drawings and in particular to FIGS. 1–5 thereof, there is illustrated one form of the golf training device, designated generally at 2, made in accordance with the present invention. In the embodiment illustrated, the golf training device includes a head 4 for having unitary side walls 8 and 10 innerconnected by a top cover or wall 14 and a front wall 12. The front 12 provides a putting face for putting a golf ball in a conventional manner. As seen, the side walls 8 and 10 together with the front wall 12 provide a generally L-shape configuration as do the side walls 8 and 10 in conjunction with the top wall 14. A golf shaft 6 is fixedly attached to the head 4 and includes a conventional type of handle (not shown) for the putter, as known in the art.

Now in accordance with the invention, a reel assembly, designated at 16, is disposed laterally within a cavity 15 the head 4 for pivotal movement about a horizontal axis during traversing movement of the putter head relative to the putting surface. In the embodiment illustrated, the reel assembly includes a pair of parallel, laterally spaced reel members 18 and 20 which are rotatably mounted on oppositely disposed end plates 22 and 24. The end plates 22 and 24 are pivotly mounted by a axle rod 26 which extends laterally between the opposed side walls 8 and 10 of the putter head 4.

The reel members 18 and 20 are carried by the axle rod 26 that is journaled for rotation in the end plates 22 and 24. The reel members each include a plurality of axially aligned disc-like elements 36 and 38 of a generally conical disc configuration that terminate in apex edges, as at 39, so as to provide a line, as opposed to a surface contact with the surface upon which the device is to operate. Preferably, the reel members are disposed so that about one-fourth the diameter of the disc elements are exposed to the putting surface.

Figure 2:
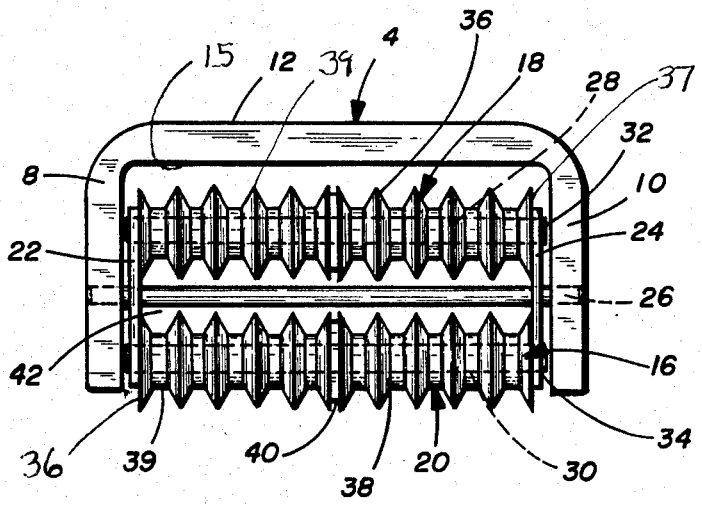
FIG. 2 is a bottom view of the golf training device looking in the direction of the line 2—2 of FIG. 1.

As best illustrated in FIG. 2, the reel members 18 and 20 may be of a unitary or two-piece construction, as at 40, or may comprise individual reel members 36 and 38, as desired. The end disc elements 35 and 37, may be of a half-disc construction so as to rotatably slide on the confronting surface of the end plates 22 and 24. In the invention, the reel members may be made of any suitable high strength, wear resistant material, such as, metal, rubber, or plastic.

By this arrangement, there is provided a dual reel assembly which is pivotly mounted for rotational movement about a horizontal axis thereby to enable the putter head to move along and follow the undulations in the putting surface, if any. The putter device with the sharply grooved, disc elements imparts a tracking effect across the surface on which it is used. This effect is provided by a maximum friction reduced by what, in effect, is a one piece reel assembly. It will be understood that there may be one, two, or any number reel members in the assembly to provide this desired tracting action. By this construction and arrangement, there is provided a controlled pathway so, as to mechanically program the users putting stroke to the form of a short, straight, take-away and return of the putter. This is in the same track and through the "ball" contact zone to complete the ideal putting stroke.

Figure 4:
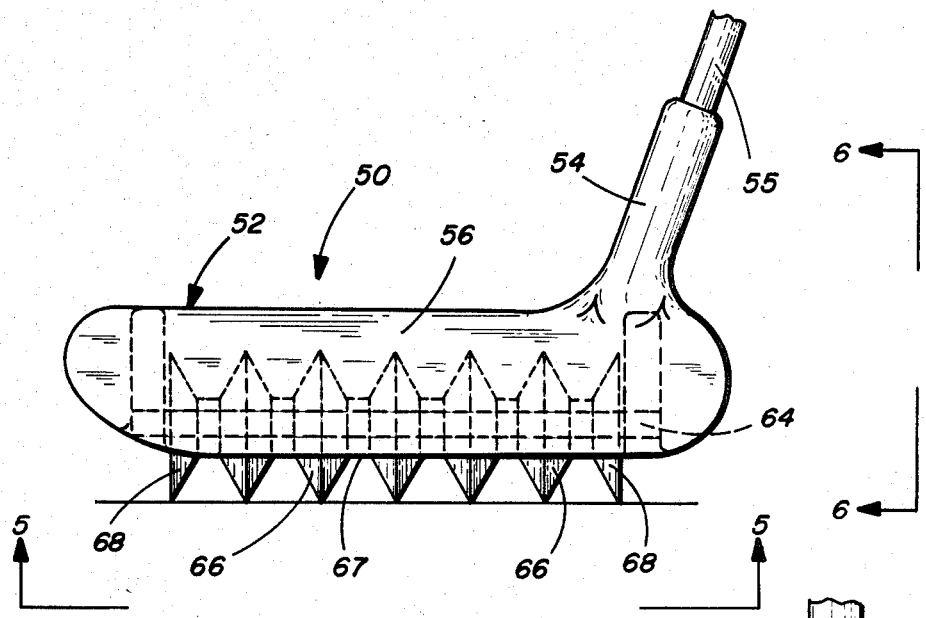
FIG. 4 is a fragmentary, side elevation view, on an enlarged scale, of the golf training device of the present invention and in a modified form thereof.
Figure 6:
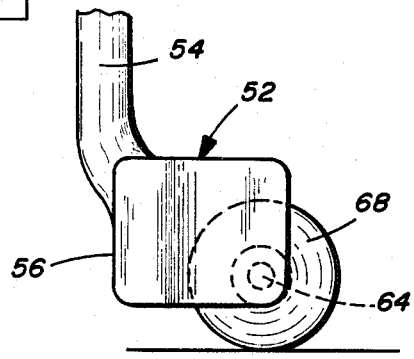
FIG. 6 is a fragmentary side elevation view looking in the direction of the line 6—6 of FIG. 4.
Figure 5:
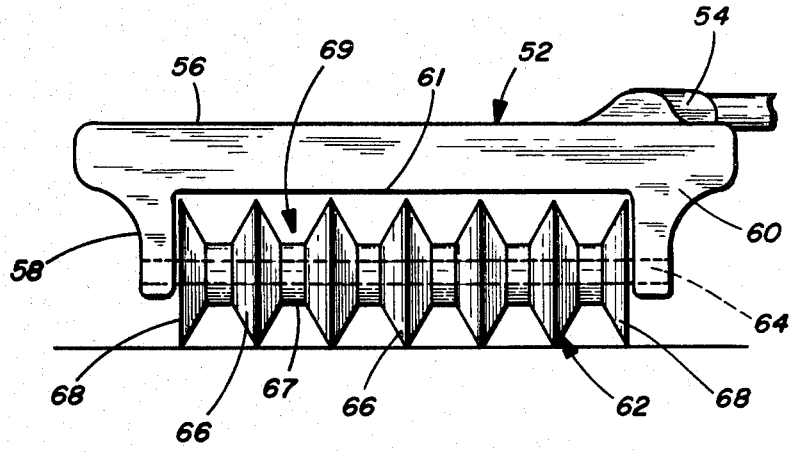
FIG. 5 is a fragmentary, bottom view looking in the direction of the line 5—5 of FIG. 4.

In FIGS. 4–6, there is illustrated another embodiment of the training putting device, designated generally at 50, but which has a single reel construction. As shown, this embodiment includes a putter head 52 including a unitary hassel 54 for mounting a shaft 55, as known in the art. In this embodiment, a single reel assembly 62 is provided which is carried by an axial rod 64 which, in turn, is journaled for rotation in a pair of unitary flanges 58 and 60 made integral with the putter head. Here again, the reel member includes a plurality of axially aligned and laterlly spaced generally conical disc members 66 that are spaced apart, as at 67, by unitary radial spacer members which define inverted, frustral-conical grooves 69 between the adjacent disc members 66. As in the embodiment of FIGS. 1–3, this construction provides an effective line-contact across the putting surface thereby to maximize the tracking ability of the putter so as to insure a straight in-line takeaway.

Figure 7:
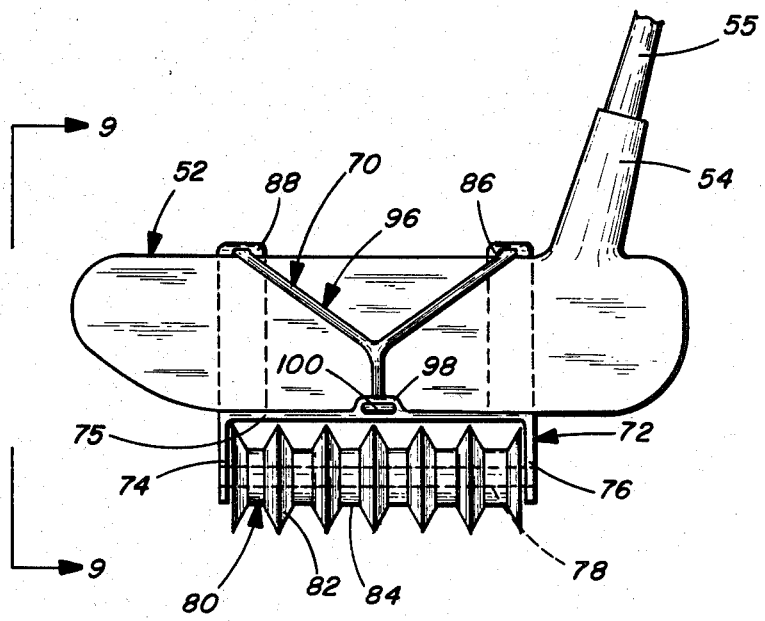
FIG. 7 is a fragmentary, side elevation view of a further modified form of a golf training device of the present invention.
Figure 9:
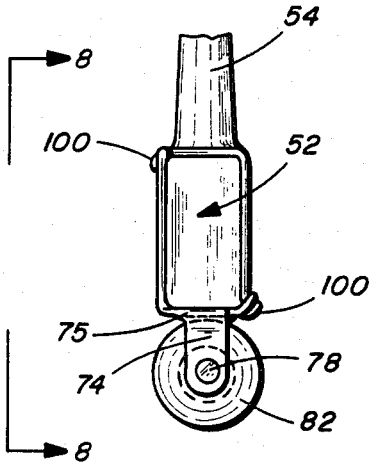
FIG. 9 is a fragmentary side elevation view of the golf training device looking in the direction of the line 9—9 of FIG. 7.
Figure 8:
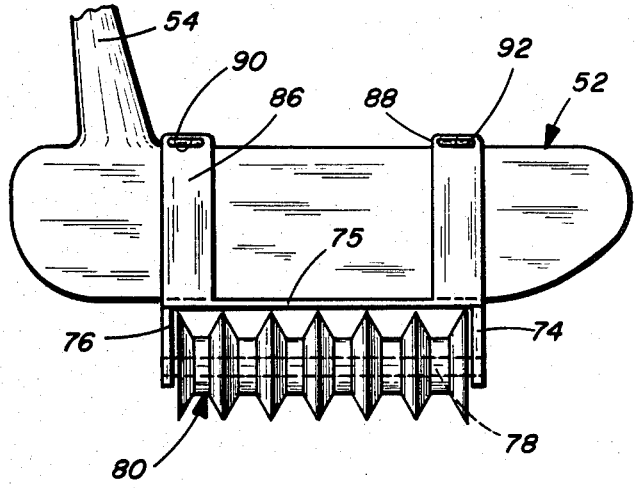
FIG. 8 is a fragmentary side elevation view looking in the direction of the line 8—8 of FIG. 9.

In FIGS. 7–9 there is illustrated another embodiment of the invention wherein the putter training device, designated generally at 70, is in the form of a detachable, snap-on assembly. Again, the putter may be of the conventional type having a putter head 52 with a hassel 54 and shaft 55. In this form, the assembly 70 includes a generally inverted, U-shaped bracket member 72 and defined by a top member 75 and a pair of unitary, downwardly extending leg members 74 and 76. The leg members rotatably journal therebetween an axle, rod 78 which carries the reel member 80 of the single construction type illustrated in FIG. 4. The reel member 80 carries a plurality of conical disc members 82 laterally separated by inverted, frusto conical grooves 84, as aforesaid.

In this embodiment, a strap assembly is utilized for detachably retaining the reel assembly on the putter head. As shown, this may include a pair of elongated laterally disposed strap members 86 and 88 made integral with the top member 75 and provided with the slots 90 and 92 adapted to receive, in locking relationship, the free ends of a generally Y-shaped elastic retainer member (i.e. rubber or the like) that is secured via another slot 98 (FIG. 7) provided on the top member 75. Accordingly, the resilient retainer member 96 includes integral, enlarged end portions, as at 100, for receipt through the corresponding slots 86, 88, and 98 thereby to detachably mount the reel assembly on the putter head.

Figure 10:
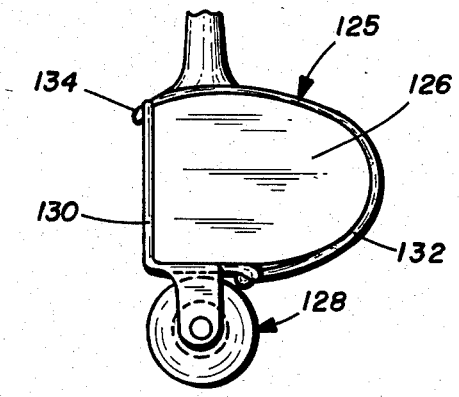
FIG. 10 is a fragmentary side elevation view of still a further modified form of the golf training device of the present invention.
Figure 11:
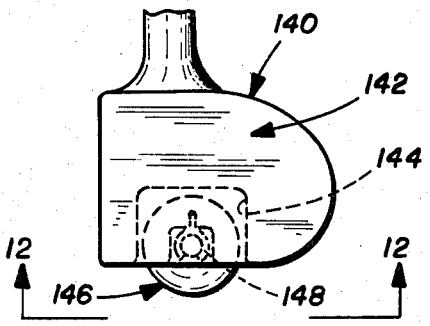
FIG. 11 is a fragementary, side elevation view of the golf training device illustrated in FIG. 10.
Figure 12:
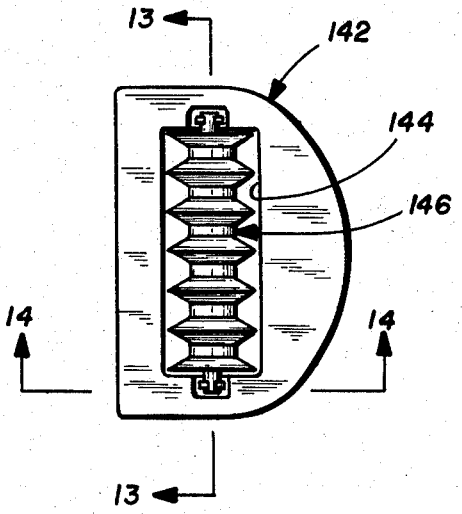
FIG. 12 is a bottom view looking in the direction of a line 12—12 of FIG. 11.
Figure 13:
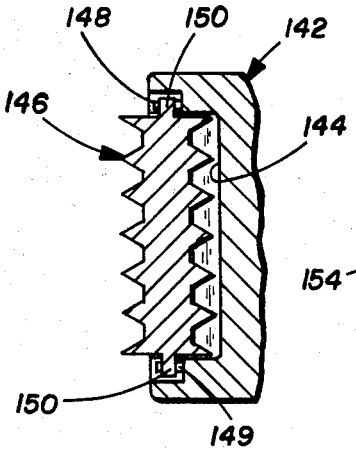
FIG. 13 is a fragmentary vertical section view taken along the line 13—13 of FIG. 12.
Figure 15:
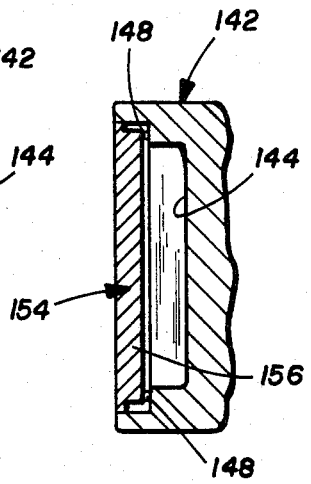
FIG. 15 is a fragmentary horizontal view similar to FIG. 13 with the cover in place.
Figure 14:
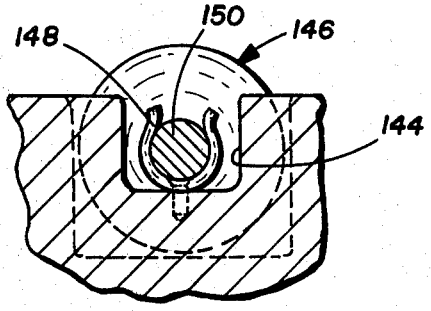
FIG. 14 is a fragmentary horizontal section view taken along the line 14—14 of FIG. 12, scale.

In FIG. 10 there is illustrated a further modified form of the putter training device, designated generally at 125, which is of a detachable, snap-on construction. This form is like that illustrated in FIGS. 7–9 but of a slightly different construction so as to accommodate a mallet-type putter.

The putter has a mallet-shaped head 126 and the reel assembly designated generally at 128, includes a generally L-shaped bracket member 130 like the reel assembly in the embodiments of FIGS. 7–9. In this form, another elastic (resilient) retainer 132 is secured to the bracket member 130 by means of the slot and enlarged end portion, as 134, securement, as aforementioned in respect to FIGS. 7 through 9.

In FIGS. 11–16 there is illustrated a further modified form of the putter training device, designated generally at 140, of the invention. In this embodiment, the putter head 142 is provided with an elongated, polygonal (rectangular) cavity 144 that detachably mounts therein a single reel assembly of the type illustrated in FIGS. 4–6 for example. In this form, the reel assembly 146 is retained within the cavity 144 by means of a pair of generally C-shaped, spring clips 148 that are fixedly secured to the body of the putter head, as at 149, within the cavity 144. These clips frictionally receive the opposed ends of the axle rod 150 so that the reel member can be rotatably held therein and removed simply by exerting an outward pulling force on the reel assembly.

Figure 16:
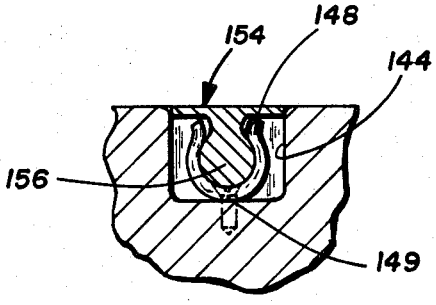
FIG. 16 is a fragmentary, section view similar to FIG. 14.

When it is desired not to use the reel assembly for training purposes, it may be removed and a cover plate 154 inserted to cover-up the cavity 144. In such case, the cover plate may include an integral rib element 156 (FIGS. 15 and 16) which may extend the length of the cover and have a generally circular configuration, in vertical cross-section, so as to be received in a snap-acting engagement within the corresponding resilient retainer clips 148, as best illustrated in FIG. 16. By this arrangement, the golf putter can be used as an effective training device in accordance with the principals of the present invention and when not so used, it can be removed and the putter then again utilized in the conventional manner. In this case, the cover plate would have the same weight as the reel assembly to be removed thereby to ensure that the putter has the appropriate legal wieght for conventional putting purposes.

In accordance with the present invention, it will be seen that though several embodiments have been described in connnection with the golf training putter device of the present invention, that still other modifications of such invention that provide an equivalent function are incorporated herein. Such other modifications are contemplated in the appended claims.

I claim:

1. A training device of the type adapted for use for putting a golf ball, said device including a putting head and which mounts a shaft adapted to carry a handle for putting the golf ball, said putter head including an elongated cavity which opens onto the bottom surface thereof, a reel assembly including a reel member disposed for rotational movement within said cavity, said reel member including a plurality of axially spaced disc elements having ground engaging surfaces, each of said disc elements including a substantially circular body having tapered side surfaces which extend outwardly and inwardly so as to imerge into a peripheral apex edge surface adapted for a substantially line-contact tracking action with the putting surface, said disc elements being defined also by unitary, radial spacer members which provide generally inverted, frusto-conical grooves between adjacent of said disc members, with said peripheral apex edge giving a line-contact across the putting surface to maximize the tracking ability of the putter head to insure a straight in-line back and forward putting stroke.

2. A training device in accordance with claim 1, including a pair of laterally spaced parallel reel members, said reel members being mounted on a bracket means, and said bracket means being mounted for pivotal movement about a horizontal axis to enable the putter head to maintain a substantially straight tracking action upon encountering undulations in the putting surface.

3. A training device in accordance with claim 2, wherein said reel members each include a plurality of axially aligned, laterally spaced disc elements, said disc elements being of a symmetrical construction and each including a substantially circular body having tapered side surfaces which define an apex edge to give a substantially line-contact during tracking movement of the putter head across the putting surface.

4. A training device in accordance with claim 1, wherein said reel member is detachably carried by resilient snap-action retainer elements mounted within said cavity for resilient insertion and removal from said cavity, and a cover member adapted to be resiliently innerlocked over said cavity upon removal of said reel member when said putter is not to be used as a training device.

5. A training device in accordance with claim 1, wherein said disc elements are of a generally conical configuration with the end disc elements being of a half-disc construction so as to rotatably slide relative to the confronting interior surface provided by the cavity in said putter head.

6. A training device in accordance with claim 5, wherein said disc elements extend downwardly approximately one-fourth the diameter of the disc elements so as to be exposed below the bottom surface of said putter head.

* * * * *